US005974634A

United States Patent [19]

Eisenpresser

[11] Patent Number: 5,974,634

[45] Date of Patent: Nov. 2, 1999

[54] DECORATIVE MULTI-USE MAGNETIC BUTTONS

[76] Inventor: Kenneth Eisenpresser, 18 Wildwood La., Greenvale, N.Y. 11548

[21] Appl. No.: 09/149,869

[22] Filed: Sep. 8, 1998

[51] Int. Cl.[6] ..... A44B 21/00

[52] U.S. Cl. ..... 24/303; 63/29.1

[58] Field of Search ..... 24/303, 114.1, 24/114.4, 104, 66.1, 113 R; 63/14.1, 900, 29.2, DIG. 3; 2/129, 139, 141.1; 248/206.5

[56] References Cited

U.S. PATENT DOCUMENTS

| | | | |
|---|---|---|---|
| 2,397,931 | 4/1946 | Ellis | 24/303 |
| 2,483,031 | 9/1949 | Avedon | 24/303 X |
| 2,601,424 | 6/1952 | Baker | 24/66.1 |
| 2,752,764 | 7/1956 | Lederer | 63/29.1 |
| 3,086,268 | 4/1963 | Chaffen, Jr. | 24/303 |
| 3,416,195 | 12/1968 | Borthwick | 24/303 X |
| 3,509,734 | 5/1970 | Lederer | 24/303 X |
| 4,059,971 | 11/1977 | Shoji | 63/14.1 |
| 5,195,336 | 3/1993 | Mershon | 63/29.1 |
| 5,450,658 | 9/1995 | Hicks | 24/303 |
| 5,517,722 | 5/1996 | Bender | 16/87.2 |
| 5,575,043 | 11/1996 | Candotti | 24/104 X |
| 5,845,373 | 12/1998 | Langer | 24/303 |

*Primary Examiner*—James R. Brittain
*Assistant Examiner*—Robert J. Sandy
*Attorney, Agent, or Firm*—Michael I. Kroll

[57] ABSTRACT

The present invention provides a decorative multi-use magnetic button construction which includes a decorative shell 18 having a cavity 12 therein which contains a first magnet 14 which contacts the base 16 of the present invention which base contacts the outer surface of, for example, a human ear 24 or garment 26 and is held in place on the ear by attraction to a second magnet 20 on the opposite side of the ear 24. This provides a structure which is securely attached to the ear 24 or garment 26 and allows interchangeable decorative shells 18 to be alternatively and permanently connected to the base 16. An additional embodiment discloses an outer shell having curled edges 22 for being more tightly attached to the base 16.

4 Claims, 10 Drawing Sheets

DECORATIVE MULTI-USE MAGNETIC BUTTONS

BACKGROUND OF THE INVENTION

1. Field of the Invention

The present invention relates generally to magnetic buttons and, more specifically, to magnetic buttons which can be used for earrings, tie tacks, pins, fasteners, paperweights and collar buttons wherein a first magnet having been enclosed within a decorative shell to form a magnetic decorative shell assembly is selectively positioned by an individual and a second magnet is oppositely placed thereby each magnet will act in concert with the other to hold the magnetic decorative shell assembly in position by inherent magnetic properties.

2. Description of the Prior Art

There are other magnetic adornment devices. Typical of these is U.S. Pat. No. 4,059,971 issued to Shoji on Nov. 29, 1977. Another patent was issued to Lederer on Jul. 3, 1956 as U.S. Pat. No. 2,752,764. Yet another U.S. Pat. No. 2,601,424 was issued to Baker on Sep. 17, 1949. Still another U.S. Pat. No. 2,397,931 was issued to Ellis on Apr. 9, 1946.

While these may be suitable for the purposes for which they were designed, they would not be as suitable for the purposes of the present invention, as hereinafter described.

U.S. Pat. No. 4,059,971

Inventor: Ota Shoji

Issued: Nov. 29, 1977

An earring construction for use by a wearer which will facilitate phone calling without interference comprises an earring decorative body which has an exterior ornamental side which normally projects outwardly from the ear and an opposite earfacing side which contains a cavity having a magnet therein. An ear engagement mounting includes a plate portion hinged to the ornament and which is attractable by the magnet in a closed position and which has an opposite earfacing side with means for engaging the earring on the ear. The hinged mounting of the ornament on the ear engagement mounting permits the ornament to be swung outwardly to the side of the ear so that the ornament does not interfere with the placing of a telephone receiver earpiece close to the user's ear.

U.S. Pat. No. Des 204,443

Inventor: Henry B. Lederer

Issued: Jul. 3, 1956

This United States Patent discloses an earring with interchangeable ornaments, such as precious or semi-precious, or artificial stones or other ornamental parts. The purpose of the invention is the creation of a type of earring in which such ornamentation may be easily and quickly removed and replaced by other ornaments by the wearer, permitting them to change the color of the stone, or the type of ornamentation to fit her taste, her dress, or the occasion; a further purpose of the invention is to provide a single pair of earrings with a variety of interchangeable stones, buttons or other ornaments, to be sold as a unit, permitting the purchaser a variety of combinations.

U.S. Pat. No. 2,601,424

Inventor: Craig C. Baker

Issued: Jun. 24, 1952

This United States Patent discloses a tie holder of the type designed to hold loose ends of a tied cravat down in place against the shirt of the wearer by providing a spring clasp with a permanent magnet attached therein which is clasped to the shirt behind the tie and a second ornamental member having a permanent magnet attached therein which is placed on the face of the tie oppositely opposed to the first magnet.

U.S. Pat. No. 2,397,931

Inventor: Robert Ellis

Issued: Apr. 9, 1946

This United States Patent discloses a magnetic button which has the general appearance of an ordinary button but is made in two associated parts which are each oppositely attached to a closure flap of a garment and hold the flaps together by inherent magnetic attraction.

SUMMARY OF THE PRESENT INVENTION

The present invention provides a decorative multi-use magnetic button construction for use by a human which includes a decorative shell exterior housing having a cavity therein which contains a first magnet which permanently connects to the base of the present invention and forms an integral magnetic decorative shell assembly which base contacts the outer surface of a human ear or garment and is held in place on the ear by attraction to a second magnet on the opposite side of the human ear. This provides a structure which is securely attached to the ear or garment and allows interchangeable magnetic decorative shell assemblies to be alternatively connected to the exterior second magnet.

A primary object of the present invention is to provide a decorative magnetic button having two permanent magnets wherein one magnet is permanently enclosed within a magnetic decorative shell assembly and the other magnet is used to affix the positioning of the first.

Another object of the present invention is to provide a magnetic earring which can be used by those who can not or will not pierce their ears.

Yet another object of the present invention is to provide a magnetic earring for those who have sensitive skin and can not wear clip-on or screwback earrings.

Still yet another object of the present invention is to provide a magnetic earring for those who believe that magnets have some medicinal properties.

Another object of the present invention is to provide a magnetic decorative shell assembly which can be attached to various parts of the human body by means of a gum substrate, such as double faced tape as an aid to circulation.

Yet another object of the present invention is to provide a magnetic decorative shell assembly that would affix itself to a garment without the necessity of making a hole.

Still yet another object of the present invention is to provide magnetic decorative shell assemblies of varying sizes, e.g, small for earrings, large for pins.

Another object of the present invention is to provide a magnetic decorative shell assembly which can be used as a decorative paperweight or clip that will not tear the paper that is held down by the magnetic decorative shell assembly and second magnet.

Yet another object of the present invention is to provide for shirts without collar buttons or stays a magnetic decorative shell assembly collar button or stay that would also hold down the collar points as well.

Additional objects of the present invention will appear as the description proceeds.

The present invention overcomes the shortcomings of the prior art by providing a magnetic decorative shell assembly comprised of a first magnet permanently enclosed within a base and acting in concert with a second external magnet.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DRAWING NUMERALS

Figure 1:
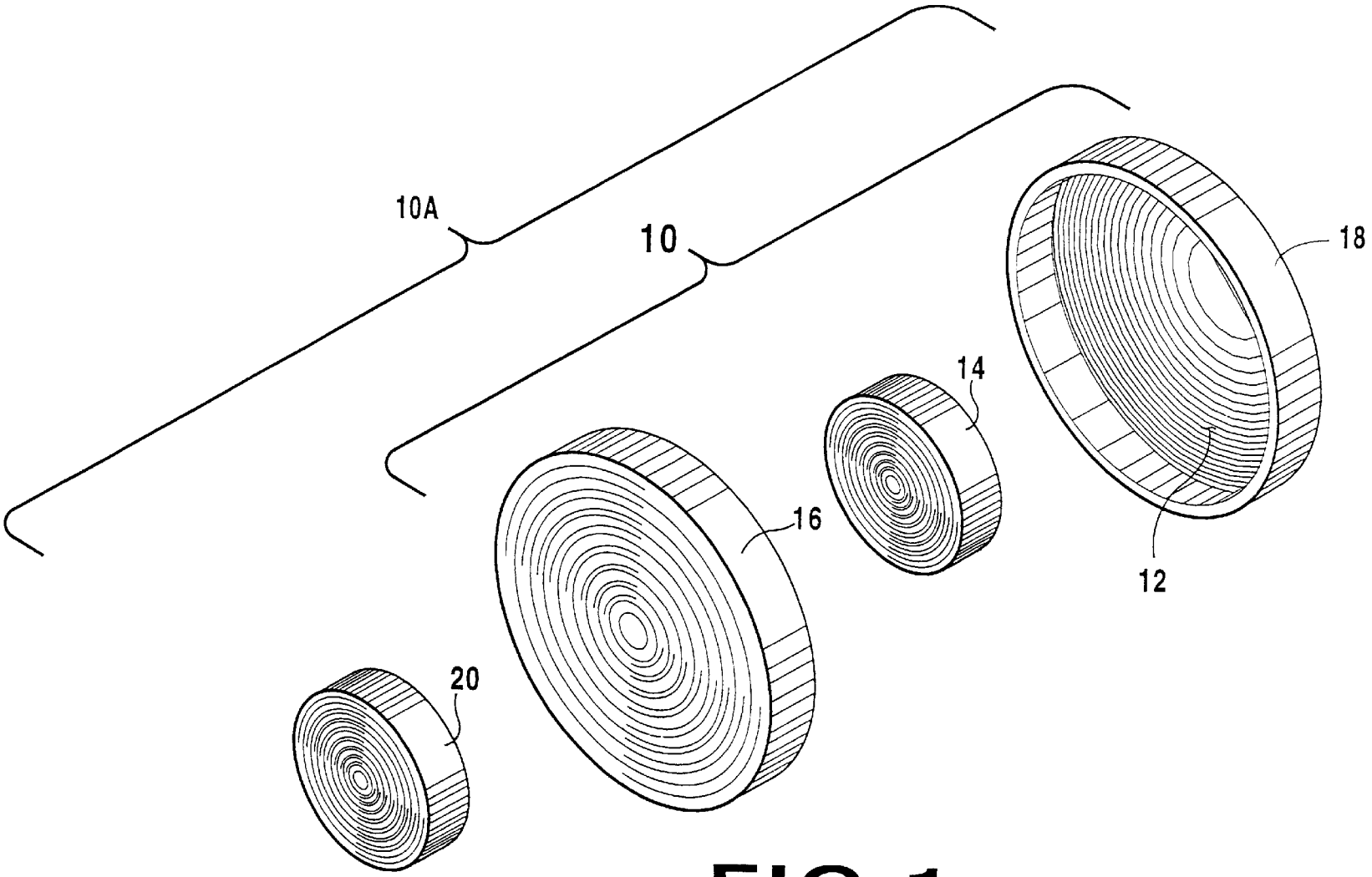
FIG. 1 is an exploded view of the preferred embodiment of the present invention. Shown is a decorative shell 18, a first permanent magnet 14, a base 16 and a second permanent magnet 20. Parts 14, 16 and 18 form the first member of the preferred embodiment of the present invention and 20 forms the second member of the preferred embodiment of the present invention.

With regard to the reference numerals, the following numbering is used throughout the various drawings.

10 magnetic decorative shell assembly (consists of items 14, 16 and 18

10A present invention (consists of magnetic decorative shell assembly 10 and second magnet 20)

12 cavity

14 first magnet (interior magnet)

16 base

18 decorative shell

20 second magnet (exterior magnet)

22 curled edge of decorative shell 18

24 human ear

26 cloth material—single layer

28 cloth material—double layer

DESCRIPTION OF THE PREFERRED EMBODIMENT(S)

Turning to FIG. 1, therein is shown an exploded view of the preferred embodiment of the present invention showing the magnetic decorative shell assembly 10, having a cavity 12 therein, which assembly 10 includes the decorative shell 18, the first interior permanent magnetic 14, and the base 16 which together forms the decorative shell assembly 10. Also shown is a second exterior permanent magnet 20. In operation the first magnet 14 is housed in cavity 12 and the decorative shell 18 is then placed onto the base 16 and closed and then this entire magnetic decorative shell assembly 10 is placed on the outer surface of a human ear or garment and held in place by attraction to the second magnet 20. The second magnet 20 forms the second member of the present invention. The decorative magnetic shell assembly 10 together with the second magnet 20 form the entire present invention 10A.

Figure 1A:
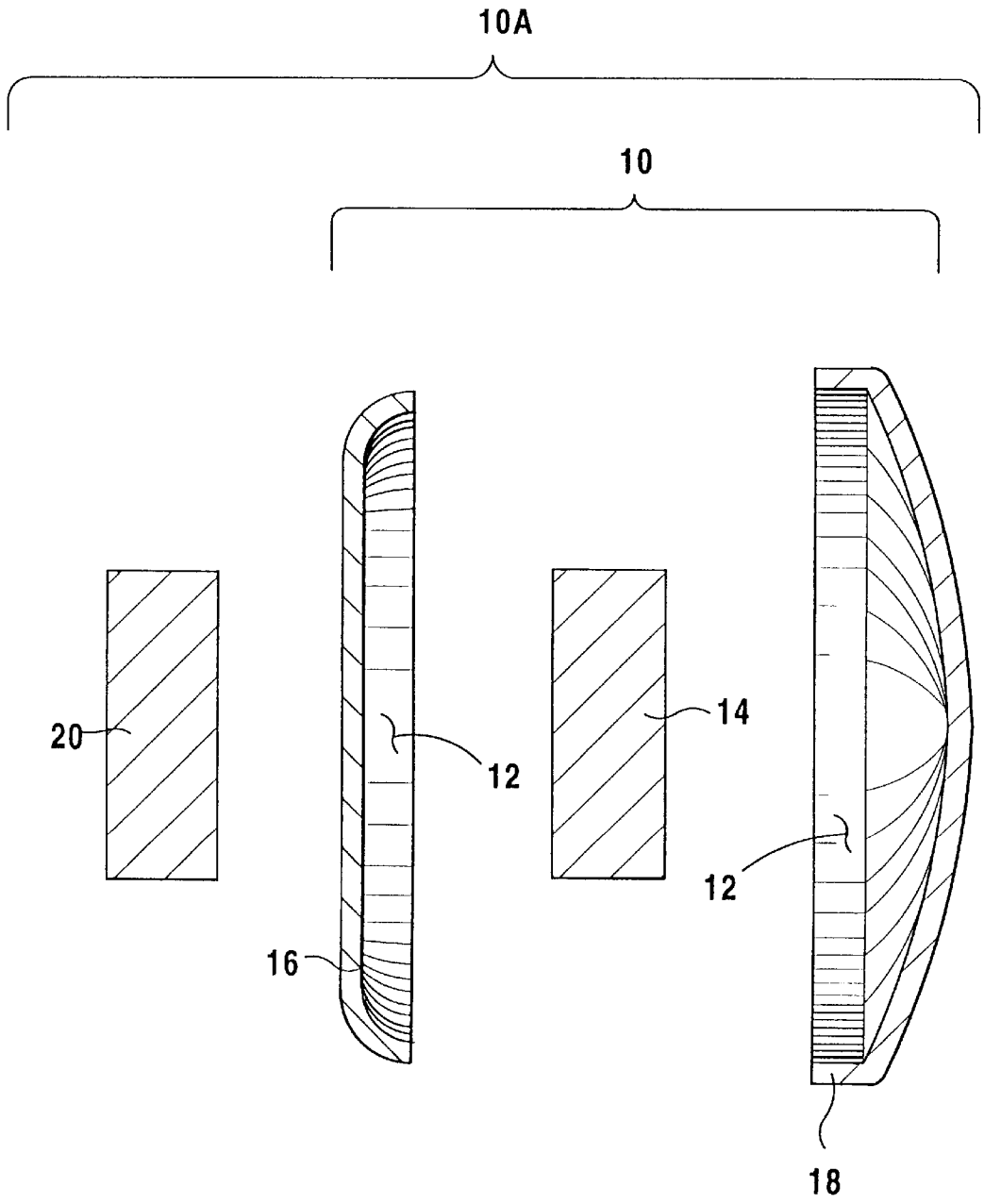
FIG. 1A is a diagrammatic exploded sectional view of the preferred embodiment of the present invention.

Turning to FIG. 1A, therein is shown a sectional view of the present invention 10A with the magnetic decorative shell assembly 10, showing the decorative shell 18 having the cavity 12 therein along with the first permanent magnet 14. Also shown is the base 16 and the second permanent magnet 20 all together forming the present invention 10A.

Figure 2:
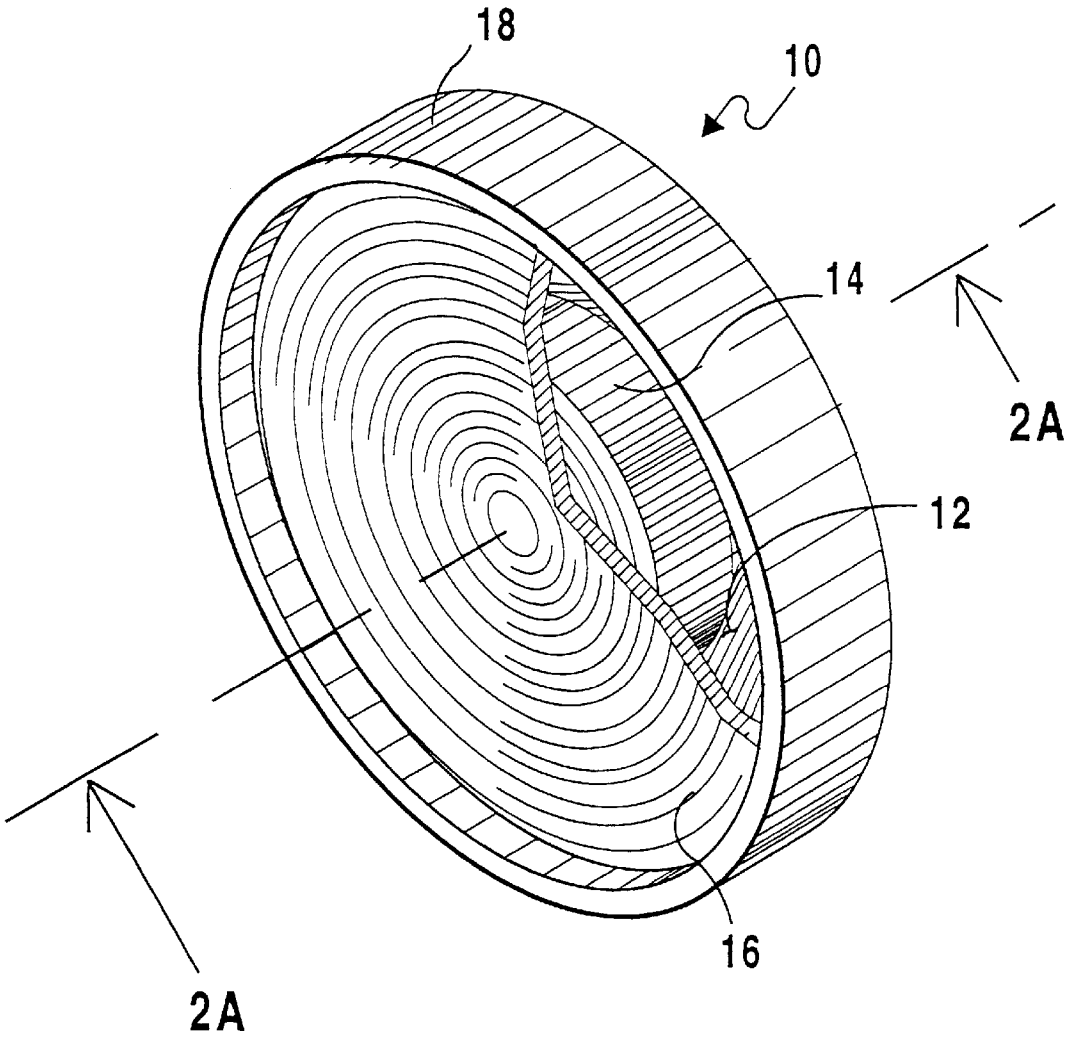
FIG. 2 is a partial sectional view of the preferred embodiment of the present invention. Shown is the first permanent magnet enclosed within the decorative shell.

Turning to FIG. 2, shown therein is a partial sectional view of the magnetic decorative shell assembly 10, the decorative shell 18 having the cavity 12 therein along with the first permanent magnet 14. Also shown is the base 16.

Figure 2A:
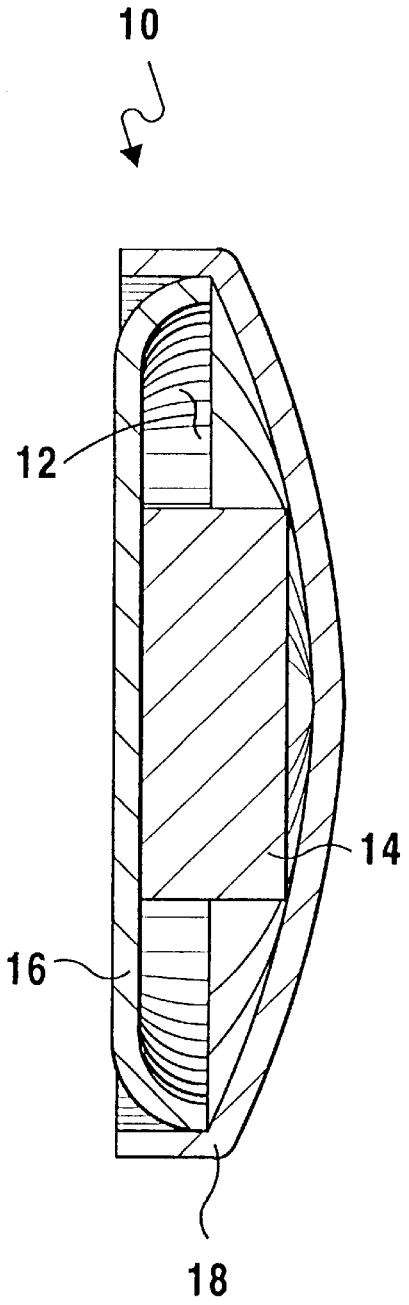
FIG. 2A is a cross sectional view, taken from FIG. 2 as indicated, showing the decorative shell which forms the first member of the preferred embodiment of the present invention.

Turning to FIG. 2A, therein is shown a cross-section view taken along the indicated line of FIG. 2, showing the first member or the magnetic decorative shell assembly 10, the decorative shell 18 having the cavity 12 therein along with the first permanent magnet 14, and the base 16. FIG. 2A further shows that the decorative shell 18 acts as a female component of the connection with the base 16 which acts as a male connecting element, base, or cup. FIG. 2A shows an unassembled view of the present invention and further shows the decorative shell 18 having uncurled edges, in preparation for being assembled into a single unit as will be shown in FIG. 3.

Figure 3:
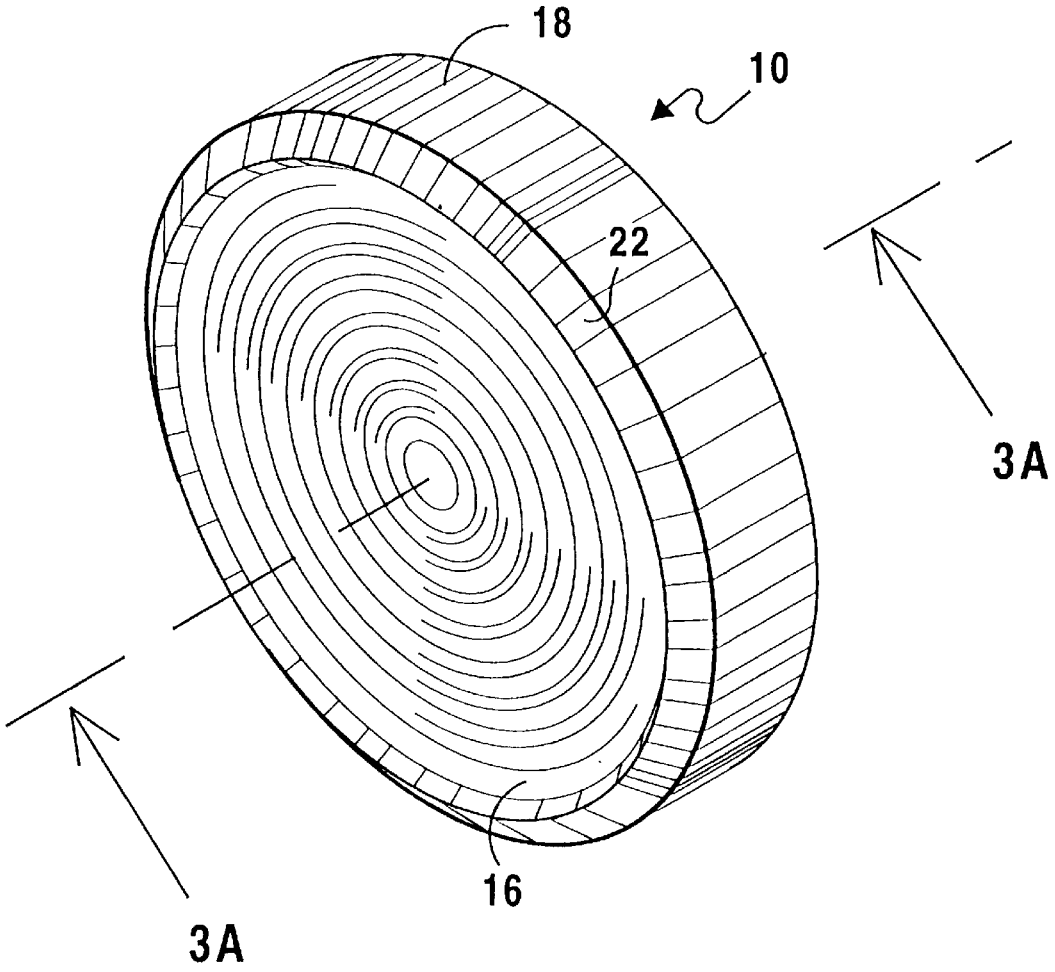
FIG. 3 is a perspective view of an alternate embodiment of the decorative shell wherein the periphery base of the decorative shell is curled to circumvent the perimeter of the base plate of the shell so that a permanent magnetic decorative shell assembly is formed.

Turning to FIG. 3, therein is shown the assembled ready to use embodiment of the present invention showing the magnetic decorative shell assembly 10 with the decorative shell 18 having curled edges 22 on its periphery with which it encompasses the edge of and is firmly attached to the base 16.

Figure 3A:
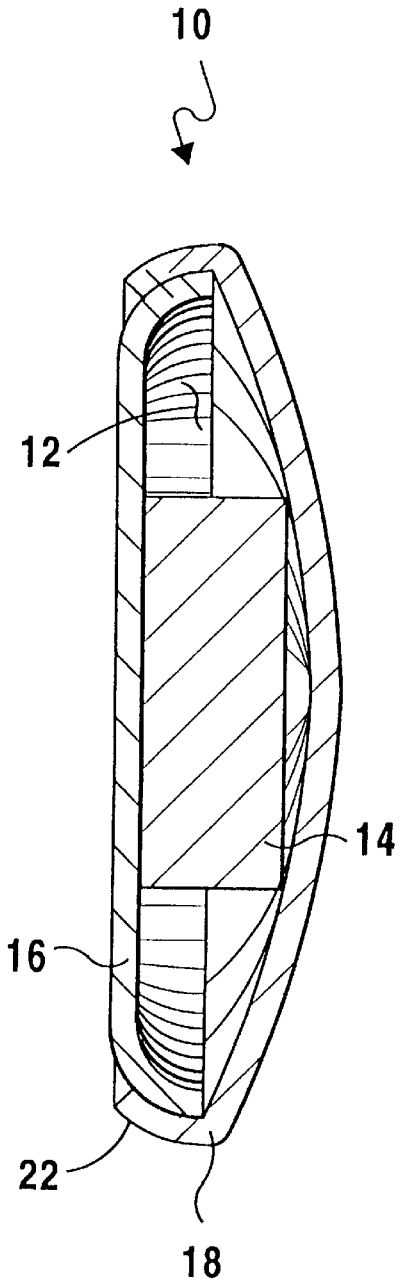
FIG. 3A is a cross sectional view, taken from FIG. 3 as indicated, showing the decorative shell of the alternate embodiment wherein the exterior cover of the shell is closed around the base plate of the housing.

Turning to FIG. 3A, therein is shown a cross-section taken from FIG. 3 showing the magnetic decorative shell assembly 10, the decorative shell 18 having a cavity 12 therein along with the first magnet 14, and the base 16. Also shown are the curled edges 22 wherewith the decorative shell 18 is firmly attached to the base 16.

Figure 4:
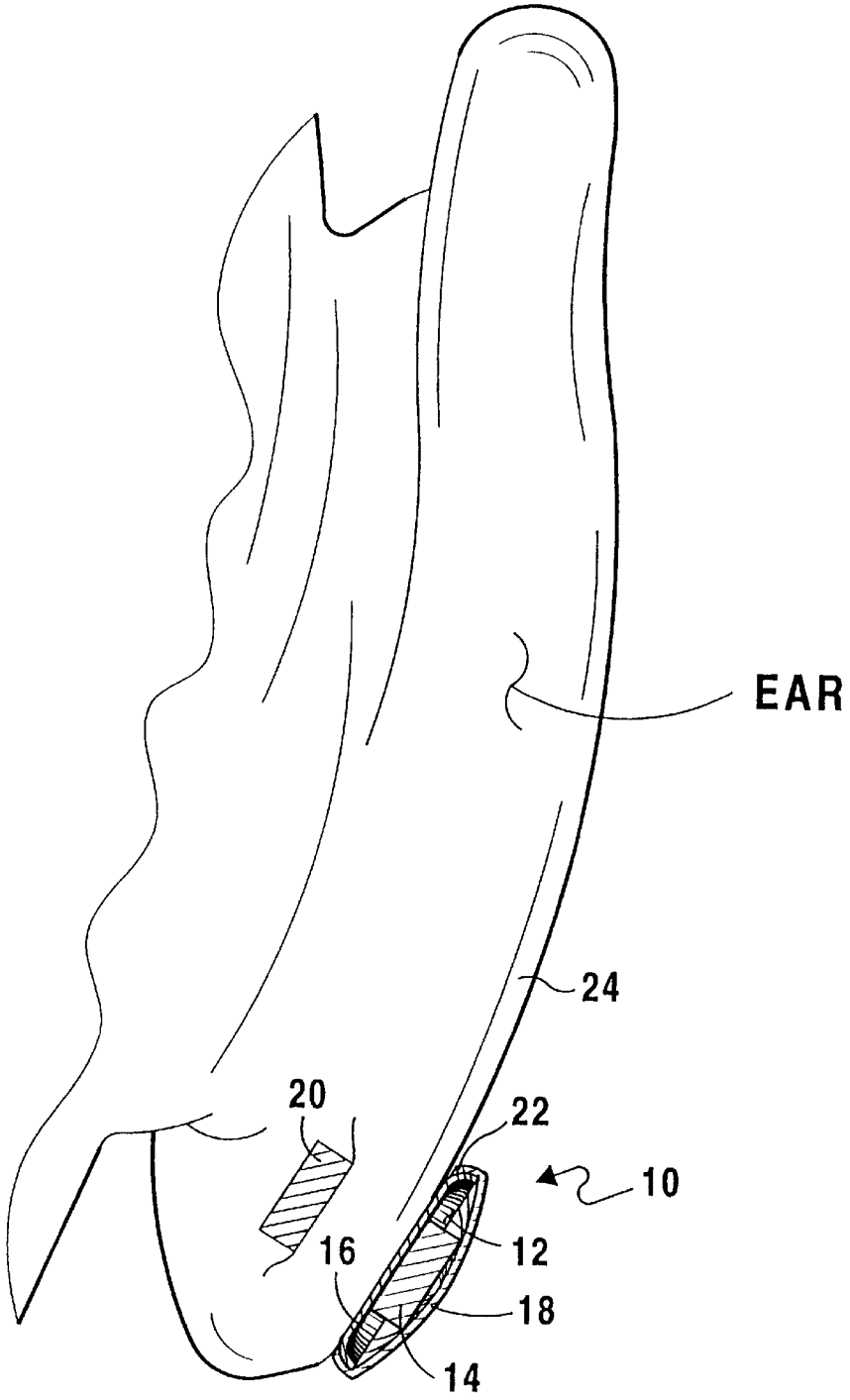
FIG. 4 is a diagrammatic perspective view of the preferred embodiment of the present invention positioned on the lower portion of an ear wherein the decorative shell assembly containing the first permanent magnet is positioned on the exterior surface of the ear and the second permanent magnet is oppositely placed on the other side of the ear.

Turning to FIG. 4, therein is shown the present invention in operative connection with a human ear 24. Shown therein is the magnetic decorative shell assembly 10, along with the decorative shell 18 of the present invention having a cavity 12 therein. Also shown is the first magnet 14 along with the base 16 and the second permanent magnet 20 on the opposite side of the ear 24. FIG. 4 discloses the operation and use of the present invention and how it is connected to an ear 24 and how the outer decorative shell 18 encloses the first magnet 14 in communication with the base 16 wherein the base 16 is inserted into the outer decorative shell 18 and held in place by the curled edges 22.

Figure 4A:
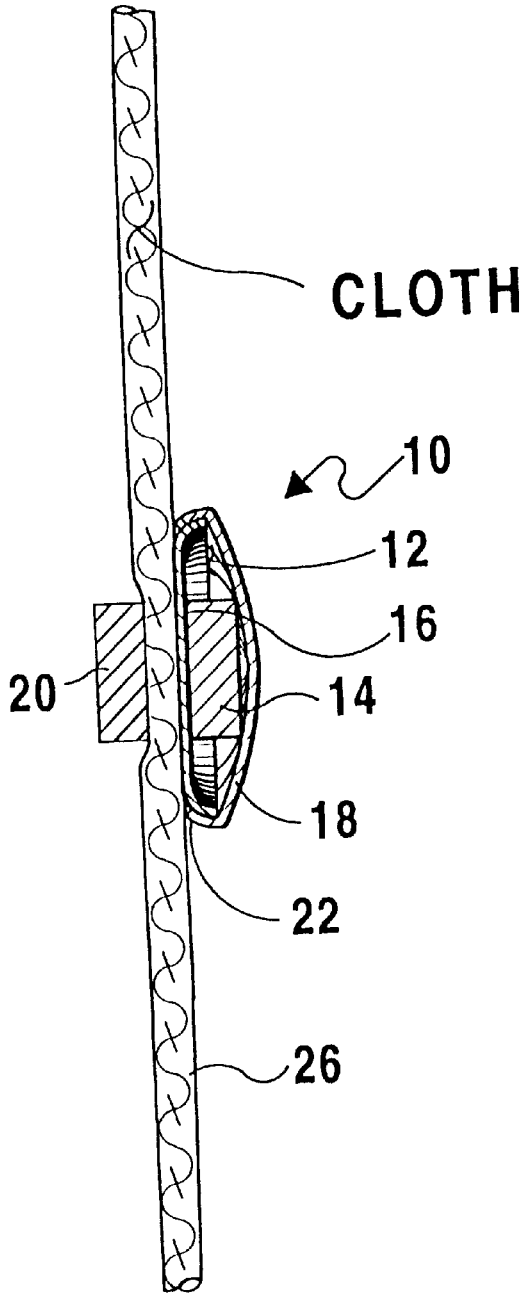
FIG. 4A is a diagrammatic sectional view of the present invention wherein the first member is placed on one side of a fabric and the second member is placed oppositely on the other side of the fabric.

Turning to FIG. 4A, therein is shown the magnetic decorative shell assembly 10 operatively connected to a garment 26 and held in place by the second magnet 20 on the opposite side of the garment 26. Also shown therein is the outer decorative shell 18 having a cavity 12 therein along with the first magnet 14, the base 16, and the curled edges 22. The magnetic decorative shell assembly 10 could also be attached to an ear or garment using double faced tape. Also, the invention could be adapted to serve as a paperweight. Furthermore, the apparatus could be adapted for use as a collar stay by substituting the collar for the garment 26.

Figure 4B:
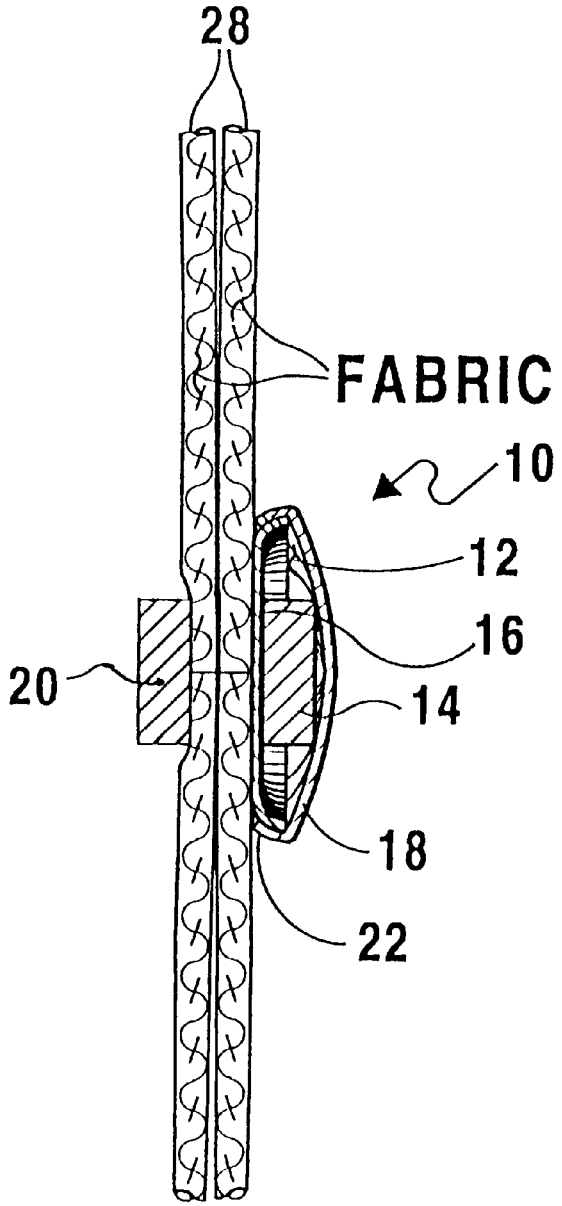
FIG. 4B is a diagrammatic sectional view showing the present invention being used to hold two layers of fabric together. Wherein the first member is placed outwardly on the first layer of fabric and the second member is placed inwardly on the second layer of fabric and opposite the first member.
Figure 5D:
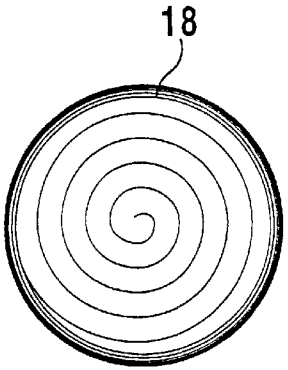
FIG. 5A–5D are examples of varying designs which can be imprinted, stamped, formed, embossed or otherwise placed on any material found suitable to function as the shell for the first permanent magnet.
Figure 5C:
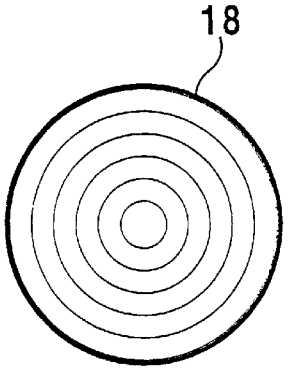
Figure 5B:
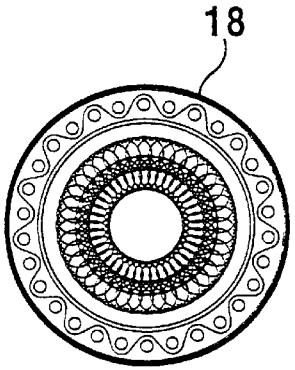
Figure 5A:
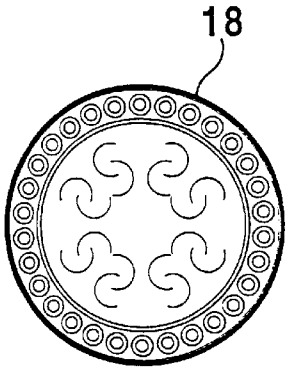

Turning to FIG. 4B, therein is shown the magnetic decorative shell assembly 10 operatively connected to a garment 28 having two layers and held in place by the second magnet 20 similarly to FIG. 4A. Also shown therein is the outer decorative shell 18 having a cavity 12 therein along with the first magnet 14, the base 16, and the curled edges 22.

Turning to FIGS. 5A, 5B, 5C, and 5D, therein are shown alternative designs of the outer surface of the decorative shell 18. These designs can be stamped, imprinted, embossed, placed or otherwise formed on any material which could function as the decorative shell 18.

It will be understood that each of the elements described above, or two or more together may also fit a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus having a first member and a second member for securing a third member therebetween, comprising:

(a) one of said members being a decorative shell assembly;

(b) said assembly including a decorative shell having a cavity herein formed by a circular disk;

(c) said decorative shell having a convex outer surface on the side opposite said cavity;

(d) a first permanent magnet centrally located within said cavity;

(e) a base comprising a flat disk covering said cavity enclosing said first magnet within said decorative shell forming said decorative shell assembly, an outer rim of said shell being curled over said base to retain said flat disk in place; and, (f) the second member comprising a second permanent magnet adjacent said base within said third member positionable between said second magnet and said base for attracting said first magnet whereby said decorative shell assembly is firmly attached to said second magnet through said third member means by attractive magnetic force.

2. The apparatus of claim 1, wherein said decorative shell assembly is adapted for use as a collar stay.

3. The apparatus of claim 1, wherein said decorative shell assembly is adapted for use as a tie tack.

4. The apparatus of claim 1, wherein said decorative shell assembly is adapted for use as an ornamental magnetic button.

* * * * *